US007227070B2

(12) United States Patent
Biba

(10) Patent No.: US 7,227,070 B2
(45) Date of Patent: Jun. 5, 2007

(54) BRASS INSTRUMENT COVER

(76) Inventor: Gregory Allen Biba, E914 Stratton Lake Rd., Waupaca, WI (US) 54981

( * ) Notice: Subject to any disclaimer, the term of this patent is extended or adjusted under 35 U.S.C. 154(b) by 513 days.

(21) Appl. No.: 10/818,129

(22) Filed: Apr. 5, 2004

(65) Prior Publication Data

US 2005/0072291 A1 Apr. 7, 2005

Related U.S. Application Data

(60) Provisional application No. 60/507,977, filed on Oct. 3, 2003.

(51) Int. Cl.
*G10G 3/00* (2006.01)

(52) U.S. Cl. ..... 84/453

(58) Field of Classification Search ..... 206/314; 84/453, 385 A

See application file for complete search history.

(56) References Cited

U.S. PATENT DOCUMENTS

| | | | | |
|---|---|---|---|---|
| 4,427,113 | A * | 1/1984 | Wanner | 206/314 |
| 4,433,781 | A * | 2/1984 | Hummel | 206/314 |
| 6,441,288 | B1 * | 8/2002 | Lin | 84/453 |
| 6,462,260 | B2 * | 10/2002 | Fediakov | 84/327 |

* cited by examiner

*Primary Examiner*—Kimberly Lockett
(74) *Attorney, Agent, or Firm*—Joseph T. Leone, Esq.; DeWitt Ross & Stevens S.C.

(57) ABSTRACT

The present invention relates to a releasably attachable C-shaped or U-shaped member that protects the slide extension of an instrument, such as a trombone or other brass instrument, from damage. The C-shaped member is dimensioned and configured to correspondingly engage with a complementary shaped portion of a musical instrument, such as the distal end of the slide extension of a trombone or other brass instrument.

7 Claims, 7 Drawing Sheets

BRASS INSTRUMENT COVER

CROSS REFERENCE TO RELATED APPLICATIONS

This application claims the benefit of U.S. provisional application Ser. No. 60/507,977, filed Oct. 3, 2003.

FIELD OF THE INVENTION

This invention relates to a cover to protect musical instruments and, more particularly, a cover to protect brass instruments of the type using a slide extension.

DESCRIPTION OF THE PRIOR ART

When playing a trombone, the instrument is supported with one hand and the slide member is controlled and moved with the other hand. Because of this arrangement, a trombone is an unwieldy and awkward instrument to play. Further still, players are discouraged from resting the instrument on their shoulder; the player must support the entire weight of the instrument with one hand. As a result, a player's arms often tire quite rapidly. Additionally, because the instrument is supported in large part by the fingers and the thumb, the wrist and forearm assume a bent and strained position. Thus, the fingers, thumb, and arm grow tired and strained, often causing extreme discomfort. The fingers especially are subject to fatigue. With increased fatigue and discomfort, the player can lose control of the instrument and cause damage to it. Damage to the slide mechanism of a trombone is quite expensive to remedy.

In part because trombones are so unwieldy (and in part because of their inherent shape), it is common for amateur and professional players alike to rest the instrument on its end whenever the instrument is not in use. To prevent damage to the end of the instrument, most trombones have a small rubber bumper or protrusion (known as an extension rest) on the distal end of the slide. Unfortunately, with heavy use, the rubber protrusion wears out, exposing the instrument to damage.

Similar to a trombone, other brass instruments, such as trumpets, French horns, baritone horns, tubas and other instruments, incorporate a tuning slide that functions on the same principal as the main slide of a trombone. (Note that trombones also have a tuning slide that extends from the back of the instrument.) A tuning slide is generally a U-shaped sliding member that is used to alters the pitch of an instrument for purposes of tuning. The tuning slide is pulled out to make the instrument lumen longer (and thus making its tone flatter), or the slide is pushed in to make the instrument lumen shorter (and thus making its tone sharper). Tuning slides are also prone to damage because they normally protrude from an exposed end of the instrument (for easy access to the player).

Adding to the expense of repair is the fact that main slide of a trombone, as well as the tuning slide of many instruments, includes a water key (i.e., a "spit valve"). If the water key is damaged, along with the slide, it too must be replaced. Thus, even when the damage is slight, repairing the damage is a job that requires highly skilled labor and is thus cost. In my instances, replacing the damaged slide element entirely, including the water key, is the only available option. Protecting the sliding elements of brass instruments in general, and trombones in particualar, is thus a critical concern for musicians, conductors, and musical directors alike.

SUMMARY OF THE INVENTION

In light of the above-noted shortcomings, it is a principal object of the present invention to provide an improved cover for protecting the slide extension of a musical instrument (especially a trombone or other brass instrument slide) from damage. Thus, the preferred embodiment of the invention is an instrument cover. The cover comprises a substantially C-shaped or U-shaped member. The member has an inner surface and an outer surface. The member is dimensioned and configured to mirror closely a complementary shaped portion of a musical instrument. In short, the inner surface of the cover fits around the outside of a portion of the instrument, either in direct physical contact with the instrument or closely adjacent to the instrument. The cover further includes a flange disposed on the inner surface. The flange is dimensioned and configured to engage the portion of the musical instrument about which the cover wraps, such that when the member is disposed about that portion of the musical instrument, the flange frictionally retains the member in place.

In another embodiment of the invention, the member further includes a groove in the peripheral edge. The groove is dimensioned and configured to allow manual access of a user to a water key disposed in the portion of the musical instrument. In this fashion, the musical instrument can be played, and the water key activated, with the cover still in place.

In the most preferred embodiment, the instrument cover is dimensioned and configured to mirror the distal shape of a trombone slide, including any extension rest found on the slide.

Thus, the present invention is a light-weight, releasably attachable device that protects the slide extension of an instrument, such as a trombone or other brass instrument, from damage. Of particular note is that the musical instrument can be played with the subject cover in place. And in certain embodiments, the water key can also be accessed and used with the cover in place.

DETAILED DESCRIPTION OF THE INVENTION

As embodied and broadly described herein, the present invention is directed to a cover for a slide extension of brass instruments. As described throughout the remainder of the disclosure, the cover of the present invention shall be described with reference to a trombone slide. This is for brevity only. The slide cover of the present invention will work in conjunction with the tuning slide or other curved passage in any type of brass instrument.

Figure 1:
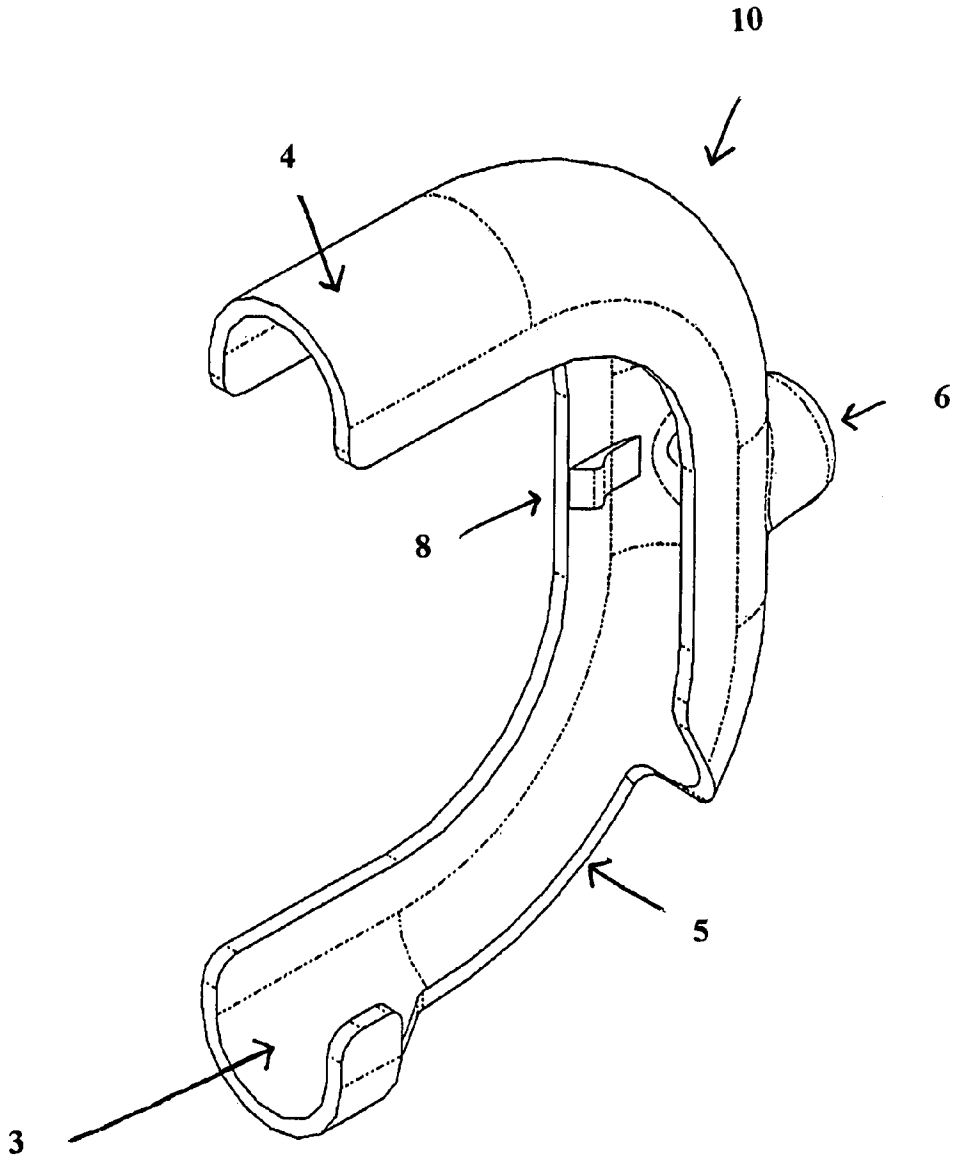
FIG. 1 is an upper left side perspective view of the invention.
Figure 2:
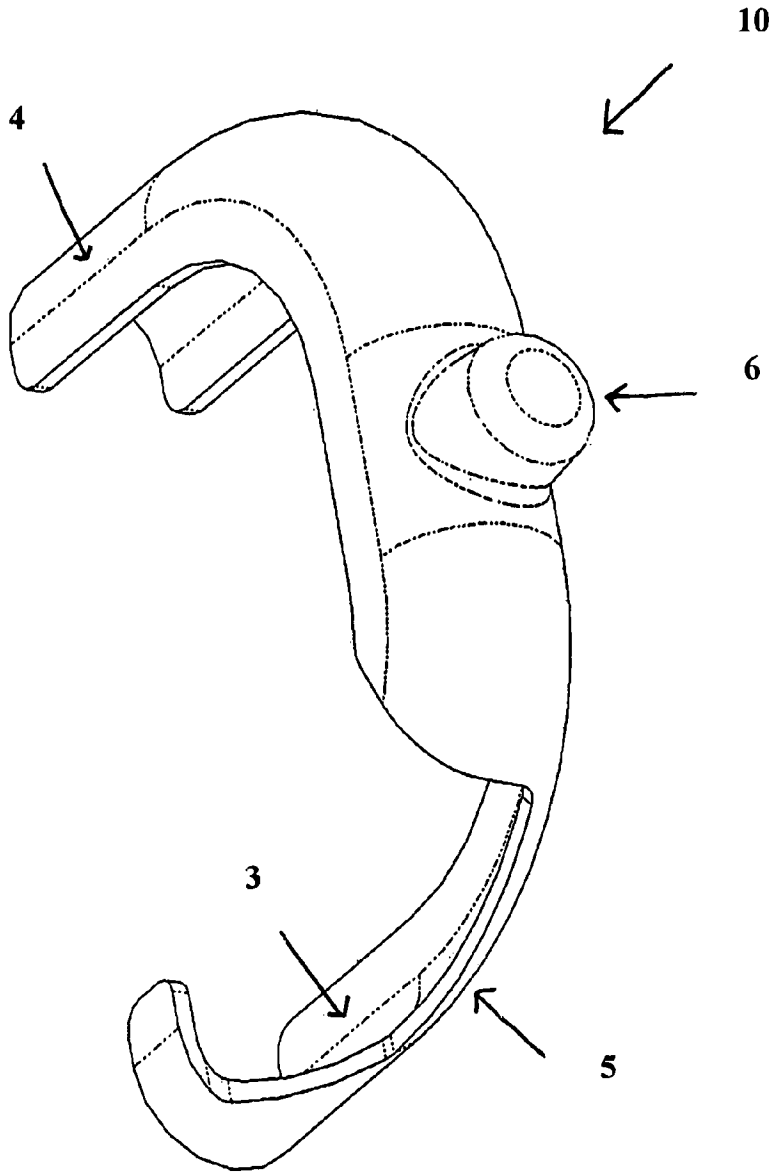
FIG. 2 is a lower right side perspective view of the invention.
Figure 3:
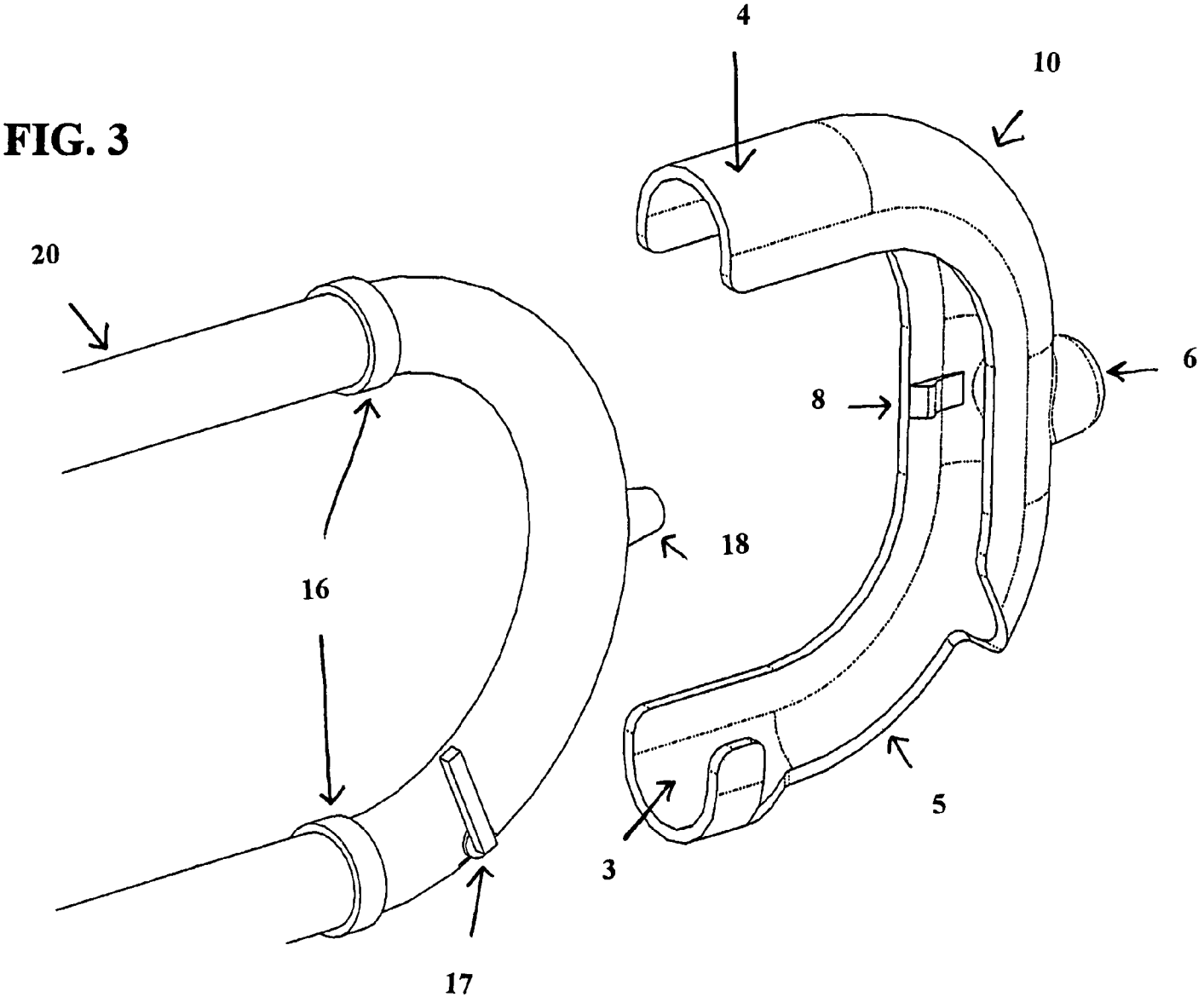
FIG. 3 is a left side isometric view of the invention as it connects to an instrument.
Figure 4:
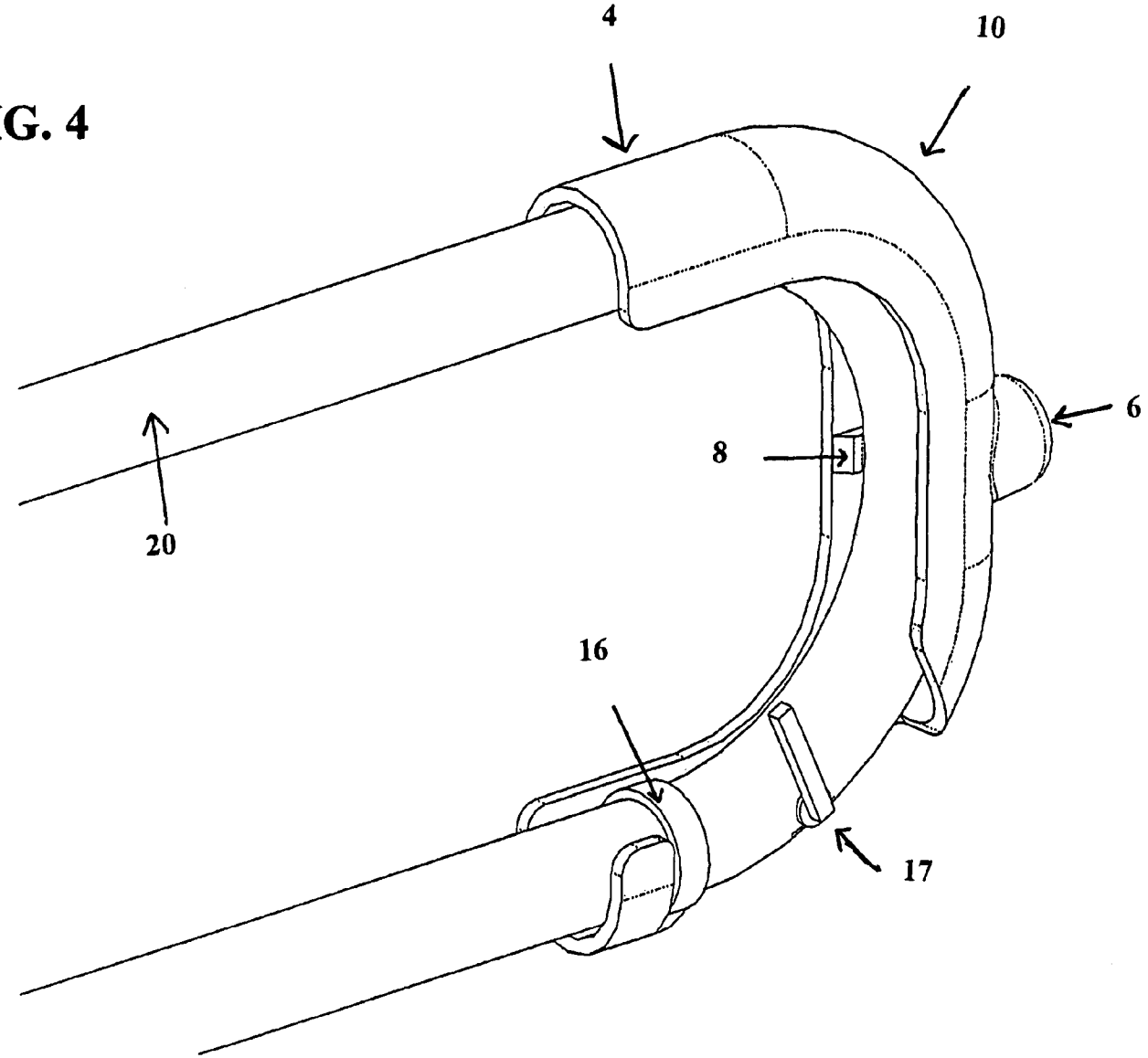
FIG. 4 is a left side perspective view of the invention connected to an instrument.
Figure 5:
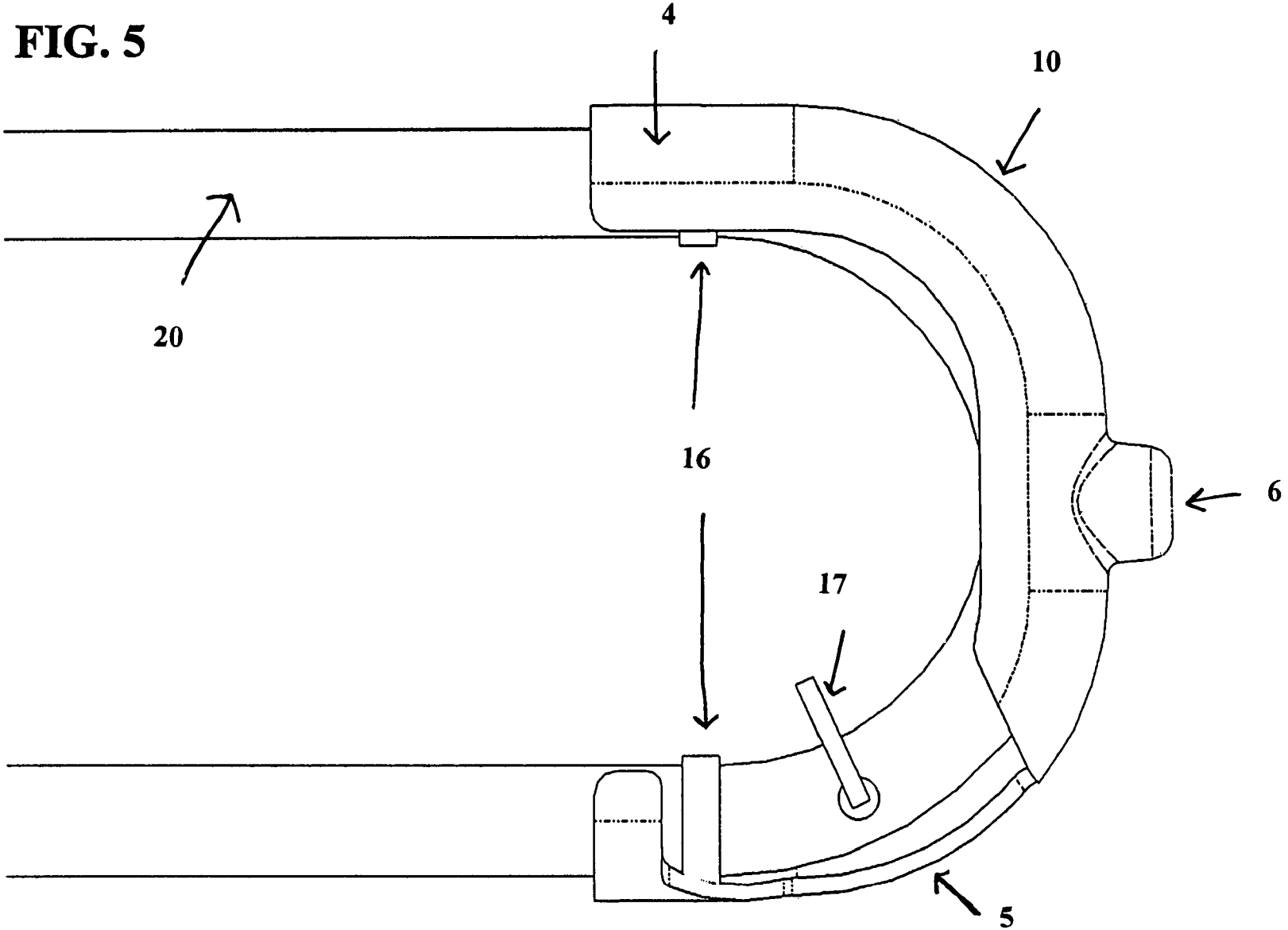
FIG. 5 is a front elevation view of the invention connected to an instrument.
Figure 6:
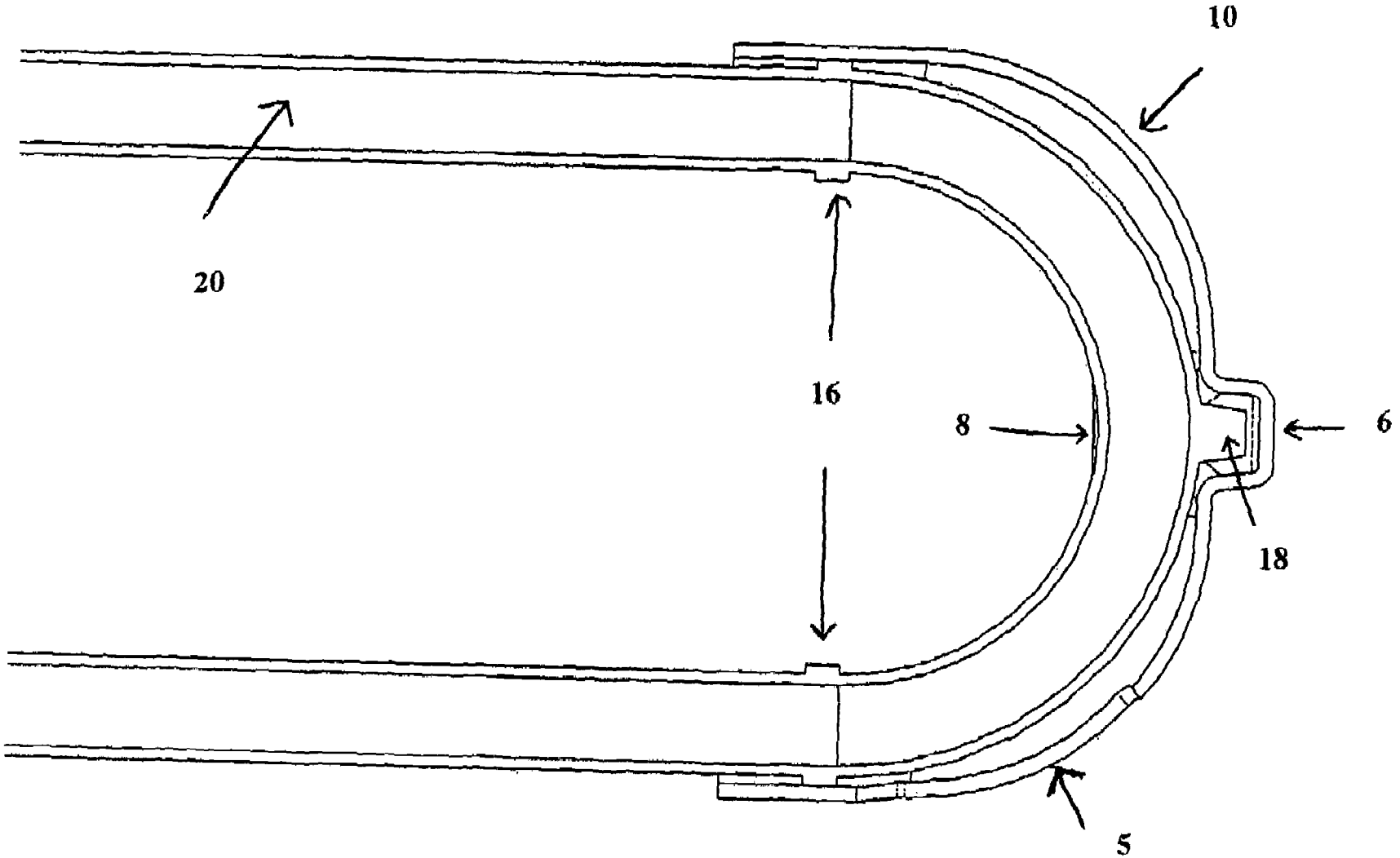
FIG. 6 is a front elevation cutaway view of the invention connected to an instrument.
Figure 7:
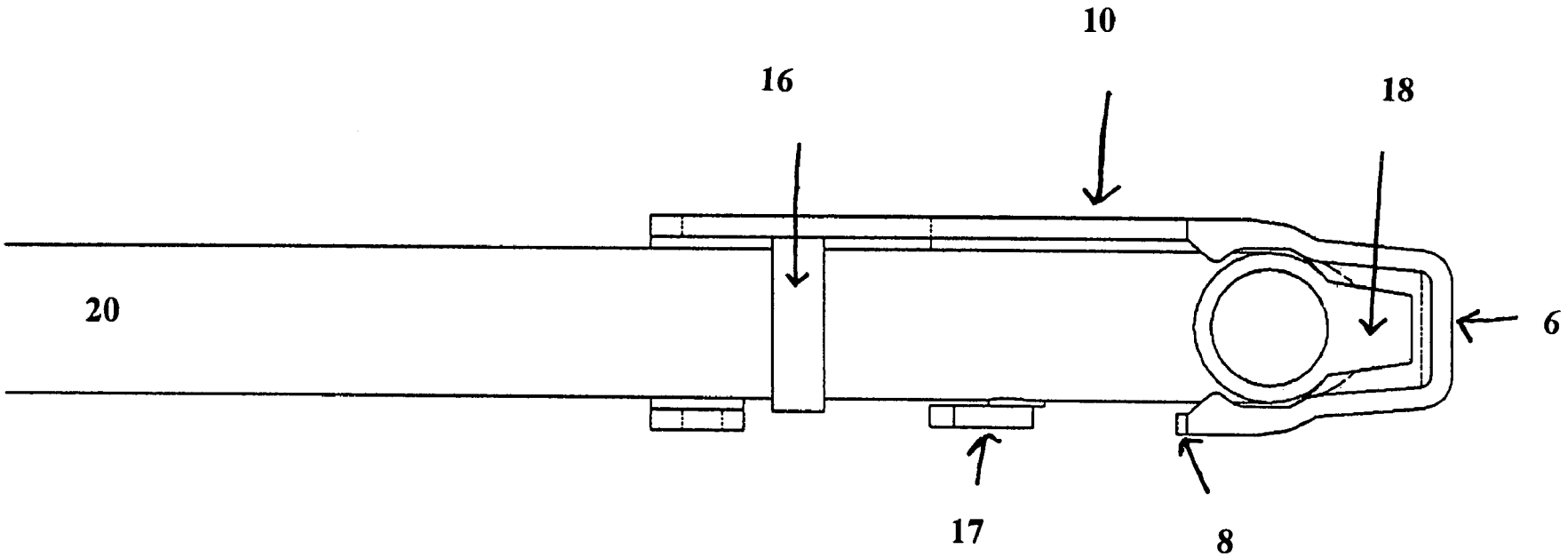
FIG. 7 is a top plan view of the invention connected to an instrument.

Referring to the drawings, where the reference numerals refer to the same elements of the invention throughout all of the figures, the present invention is a substantially C-shaped or U-shaped cover 10 configured to matingly engage a complementary shaped portion of a musical instrument (See FIG. 1). Specifically, the distal end of the C-shaped cover 10 contains an outer protruberance 6 to accommodate the rubber stopper 18 on a trombone slide 20 (See FIG. 2). Further, the inner surface of the C-shaped cover 10 contains a flange 8 configured to matingly engage the cover 10 to a complementary shaped portion of a musical instrument (See FIG. 3). The C-shaped cover 10 of the present invention defines an inner surface 3 and an outer surface 4 which connect to an instrument just above ferrules 16 found on both ends of a trombone slide 20 (See FIG. 4). (Note that the trombone slide itself forms no part of the subject invention.) The groove 5 on the outer surface 4 of the cover 10 accommodates a water key (i.e., a "spit valve") 17 on a musical instrument such as a trombone 20 (See FIG. 5). When the C-shaped (or U-shaped) cover 10 is attached to an instrument, the flange 8 matingly engages the inner surface of the instrument slide while the ferrules 16 and spit handle 17 on an instrument are accommodated (See FIG. 6 and FIG. 7).

As shown throughout the figures, the cover does not interfere with the playing of the instrument or the operation of the water key. Thus, the cover can be affixed about a portion of the instrument and left in place while the instrument is played and while the instrument is stored in its case.

It is understood that the present invention is not confined to the particular construction and arrangement of parts herein illustrated and described, but embraces such modified forms thereof as come within the scope of the following claims.

What is claimed is:

1. An instrument cover comprising:

a substantially C-shaped or U-shaped member, the member defining an inner surface and an outer surface and wherein the member further comprises a peripheral edge and defines at least one groove in the peripheral edge, the groove being dimensioned and configured to allow manual access of a user to a water key disposed in the portion of the musical instrument; and a flange disposed on the inner surface of the member;

wherein the member is dimensioned and configured to mirror a complementary shaped portion of a musical instrument; and wherein the flange is dimensioned and configured to engage the portion of the musical instrument, such that when the member is disposed about the portion of the musical instrument, the flange frictionally retains the member in place.

2. The instrument cover of claim 1, wherein the member is dimensioned and configured to mirror the shape of a trombone slide.

3. The instrument cover of claim 2, wherein the member further comprises a peripheral edge and defines at least one groove in the peripheral edge, the groove being dimensioned and configured to allow manual access of a user to a water key disposed in the portion of the musical instrument.

4. An instrument cover comprising:

a substantially C-shaped or U-shaped member, the member defining an inner surface and an outer surface and wherein the member further includes a protruberance defined on the outer surface and a corresponding indentation defined on the inner surface, wherein the protruberance and the indentation together are dimensioned and configured to mirror a complementary shaped extension rest on the musical instrument; and a flange disposed on the inner surface of the member;

wherein the member is dimensioned and configured to mirror a complementary shaped portion of a musical instrument; and wherein the flange is dimensioned and configured to engage the portion of the musical instrument, such that when the member is disposed about the portion of the musical instrument, the flange frictionally retains the member in place.

5. The instrument cover of claim 4, wherein the member is dimensioned and configured to mirror the shape of a trombone slide.

6. The instrument cover of claim 5, wherein the member further comprises a peripheral edge and defines at least one groove in the peripheral edge, the groove being dimensioned and configured to allow manual access of a user to a water key disposed in the portion of the musical instrument.

7. An cover for a trombone slide comprising:

a substantially C-shaped or U-shaped member, the member having an inner surface and an outer surface and having a peripheral edge that defines at least one groove therein, the groove being dimensioned and configured to allow manual access of a user to a water key disposed in the trombone slide;

wherein the member further includes a protruberance defined on the outer surface and a corresponding indentation defined on the inner surface, wherein the protruberance and the indentation together are dimensioned and configured to mirror a complementary shaped extension rest on the trombone slide;

a flange disposed on the inner surface of the member; and wherein the member is dimensioned and configured to mirror a complementary shaped portion of a trombone slide; and wherein the flange is dimensioned and configured to engage the trombone slide, such that when the member is disposed about the trombone slide, the flange frictionally retains the member in place.

* * * * *